US005842804A

United States Patent [19]

Hurlburt

[11] Patent Number: 5,842,804

[45] Date of Patent: Dec. 1, 1998

[54] LIPSTICK CASE WITH MEANS FOR PUSH-BACK PREVENTION

[75] Inventor: David R. Hurlburt, West Cornwall, Conn.

[73] Assignee: Rexam Cosmetic Packaging, Inc., Torrington, Conn.

[21] Appl. No.: 736,509

[22] Filed: Oct. 24, 1996

[51] Int. Cl.[6] ..... A45D 40/12; A45D 40/06

[52] U.S. Cl. ..... 401/78; 401/74; 401/77; 401/87

[58] Field of Search ..... 401/78, 87, 74, 401/77

[56] References Cited

U.S. PATENT DOCUMENTS

| | | | |
|---|---|---|---|
| 2,212,573 | 8/1940 | Peterson | 401/78 |
| 2,284,162 | 5/1942 | McKnight et al. | 401/87 X |
| 2,302,459 | 11/1942 | Noel . | |
| 3,124,245 | 3/1964 | Hopgood | 401/78 |
| 3,137,275 | 6/1964 | Spatz | 401/77 X |
| 3,310,168 | 3/1967 | Landen | 401/78 |
| 3,512,896 | 5/1970 | Gruska | 401/78 |
| 4,770,556 | 9/1988 | Ackermann et al. . | |
| 4,815,485 | 3/1989 | Morel . | |
| 4,917,133 | 4/1990 | Morel . | |
| 5,172,993 | 12/1992 | Ackermann et al. . | |
| 5,302,042 | 4/1994 | Ackermann . | |
| 5,324,126 | 6/1994 | Holloway et al. . | |
| 5,451,113 | 9/1995 | Lund et al. . | |

FOREIGN PATENT DOCUMENTS

| | | | |
|---|---|---|---|
| 909021 | 4/1946 | France | 401/78 |
| 361096 | 5/1962 | Switzerland | 401/78 |
| 651582 | 4/1951 | United Kingdom | 401/78 |
| 95/16773 | 6/1995 | WIPO . | |

*Primary Examiner*—Steven A. Bratlie
*Attorney, Agent, or Firm*—Bell Seltzer Intellectual Property Law Group of Alston & Bird LLP

[57] ABSTRACT

A cosmetic container for a cosmetic, such as lipstick, which permits the cosmetic to be extended and retracted for application and which permits a low swivel torque, which operates smoothly, and which substantially minimizes or prevents "push-back". The container includes a uniquely configured lug which cooperates with a helical channel of a tubular sleeve to prevent push-back which is defined as unwanted movement of the lipstick within the container caused by downward axial force which results when the lipstick is applied. According to one embodiment, the lug includes an end surface portion having a compound surface wherein one portion thereof is parallel to the longitudinal axis and another portion thereof is positioned at an acute angle to the longitudinal axis. The compound surface also includes a line of intersection defining the portions which is, itself, angularly positioned relative to a plane normal to the longitudinal axis. The compound surface abuts either an inner surface the tubular sleeve or a sidewall of the helical channel when downward axial pressure is applied to the lipstick and the carrier supporting the lipstick. According to an alternative embodiment, the lug end surface portion includes a convex protrusion and the helical channel includes a correspondingly configured concave portion to receive the convex protrusion.

33 Claims, 4 Drawing Sheets

LIPSTICK CASE WITH MEANS FOR PUSH-BACK PREVENTION

FIELD OF THE INVENTION

The present invention is directed to a lipstick container having means for preventing "push-back" of the lipstick, i.e, unwanted retraction of the lipstick into the container during application thereof.

BACKGROUND OF THE INVENTION

Companies, such as cosmetic companies, are ever aware of quality conscious consumers and continuously strive to provide cosmetic products which themselves are of high quality and which are packaged with the consumers preferences in mind. Packages which provide both aesthetic and functional benefits are most desirable in the cosmetic industry. These benefits are particularly applicable in the lipstick market where quality lipstick packages have become a major force.

Conventional lipstick containers include a cosmetic carrier, a tubular inner sleeve, a tubular outer sleeve and a decorative sleeve. The cosmetic carrier supports the lipstick and is generally configured as a sleeve having radially extending lugs on opposing sides and is received within the inner sleeve. The inner sleeve defines longitudinally extending channels on opposing sides wherein the lugs of the cosmetic carrier extend therethrough. An outer sleeve defining a continuous helical channel is positioned about the intermediate sleeve wherein the lugs of the cosmetic carrier are configured to be received and to traverse along the length of the helical channel. This results in the cosmetic carrier being moved upwardly as the lugs traverse the length of the helical channel when a bottom portion of the intermediate sleeve is rotated. The decorative outermost sleeve is provided for aesthetic purposes. In operation, a bottom portion of the inner sleeve extends beyond the bottom of the outer decorative sleeve. The user rotates the bottom portion to cause the cosmetic carrier and, hence, the lipstick to extend from the case for applying the lipstick and to retract into the case for storage.

It is particularly desirable to provide a lipstick container having a smoothly rotating movement and permitting low swivel torque to extend and retract the cosmetic carrier. However, the reduced swivel torque permits the lugs positioned within the helical channel to more readily slide downward within the channel under the influence of downward axial force or pressure, such as when the lipstick is being applied, causing unwanted retraction of the lipstick into the container. This is referred to as "push-back". Push-back has been an undesirable side effect of providing a smoothly operating lipstick container permitting low swivel torque to extend and retract the lipstick therein.

Prior art has addressed this problem, but the proffered solutions are, indeed, incomplete solutions. Although providing a solution of preventing push-back, the prior art attempts do so at the expense of providing a smoothly operating container. Further, such devices are complicated to manufacture, are costly, and, therefore, provide an inefficient solution.

For instance, U.S. Pat. No. 5,302,042 ("the '042 patent") to Ackermann is directed to a lipstick container for preventing the aforementioned push-back. The push-back prevention feature of the '042 patent is achieved by the combination of tear-drop shaped lugs and longitudinal channels having a ratchet-like stepped profile. Accordingly, as the pomade cup is moved upward along the spiral openings, the point of the tear-drop shaped lug falls against a "step" of the channel. This, however, as set forth in that patent, "produces a slight 'ratcheting' feel". Thus, this arrangement sacrifices smooth operation to achieve push-back prevention. Further, push-back is only incrementally prevented as the pomade cup may be pushed back until the point of the tear-drop shaped lug contacts the next "step" of the channel.

SUMMARY OF THE INVENTION

It is therefore an object of the present invention to provide a lipstick container to achieve push-back prevention while simultaneously providing the advantages of a smoothly operating mechanism.

The present invention overcomes the drawbacks and shortcomings of the prior art by providing a cosmetic container which effectively and efficiently prevents push-back of the cosmetic during application or other downward axial force. This is achieved, in part, by providing a lug extending radially outward from the cosmetic carrier and having an end surface portion which is uniquely configured to prevent downward movement under a downward axial force applied to the cosmetic. The lug includes a radially outwardly facing end which has a compound surface. According to a first embodiment of a present invention, at least a portion of the facing end is angled or chamfered for wedging against the inner surface of a first tubular sleeve or the lower sidewall of the helical channel to prevent downward movement of the cosmetic carrier under downward axial force applied to the cosmetic, such as when the cosmetic is applied. In an alternative embodiment, the helical channel is correspondingly configured to the surface portion of the lug having the compound surface. According to a third embodiment of the present invention, the radially outwardly facing end includes a convex protrusion. The helical channel may be correspondingly configured wherein the bottom wall of the channel includes a concave surface portion so as to cooperate with the facing end of the lug. Accordingly, a relatively large pitched and sloped helical channel may be utilized to enhance operation with a low swivel torque while minimizing, if not substantially eliminating, the occurrence of push-back. Moreover, this is achieved without adversely affecting the smoothness of the container's operation and is achieved in a manner which is easily manufactured and uncomplicated and, yet, most effective.

BRIEF DESCRIPTION OF THE DRAWINGS

The foregoing and other objects, features, and advantages of the present invention will be made apparent from the following detailed description of the preferred embodiment of the invention and from the drawings, in which.

DETAILED DESCRIPTION OF THE DRAWINGS

Figure 1:
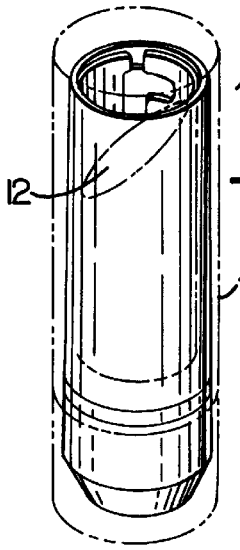
FIG. 1 is a perspective view of a cosmetic container according to the present invention.

The present invention will now be described more fully in detail with reference to the accompanying drawings, in which preferred embodiments of the invention are shown. This invention should not, however, be construed as limited to the embodiments set forth herein; rather, they are provided so that this disclosure will be thorough and complete and will fully convey the scope of the invention to those skilled in the art.

The present invention is shown and described herein as a container for applying cosmetics, such as lipstick. For the sake of brevity, the description which follows will refer to a lipstick container. However, it should be evident that the container has utility in various other areas wherein a product is to be extended from and retracted into a case. For instance, the container may be utilized for any product requiring topical application.

The lipstick container of the present invention, indicated by the reference character 10, is designed for dispensing lipstick 12, shown in phantom, so that it may be cosmetically applied. An outer enclosure 14, shown in phantom, may also be provided as a protective outer enclosure for the lipstick container 10. The lipstick container 10 includes a plurality of tubular members which are concentrically arranged about the longitudinal axis. The lipstick 12 is positioned within a cosmetic carrier 16 to secure the lipstick therein. The cosmetic carrier includes a base 20 and a cylindrical sidewall 22 extending upwardly from the base 20 to define a cup for receiving and holding the lipstick. The cosmetic carrier 16 also includes a pair of lugs 24 positioned on diametrically opposing outer surfaces of the cylindrical sidewall 22. Although the lugs 24, as shown, are provided as a pair and are diametrically opposed, it would not be a departure from the scope of the present invention to provide one or any number of lugs in any location along the outer surface of the cosmetic carrier 16.

Figure 2:
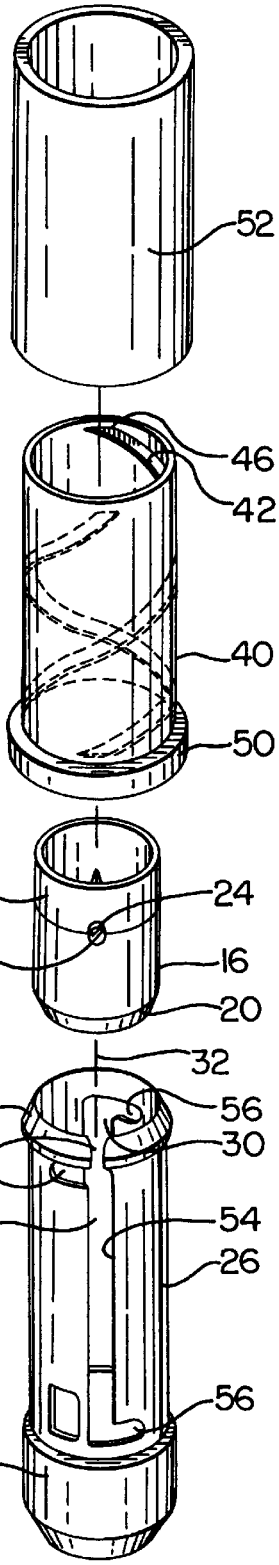
FIG. 2 is an exploded view of the cosmetic container of FIG. 1.
Figure 3:
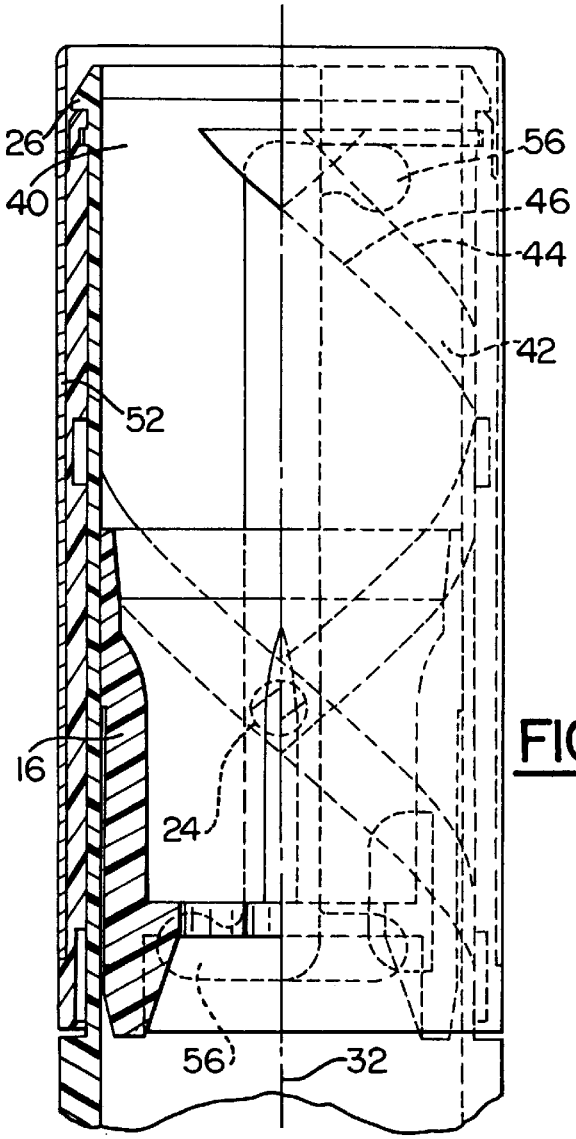
FIG. 3 is a partial cross-sectional view of the cosmetic container of FIG. 1.
Figure 5:
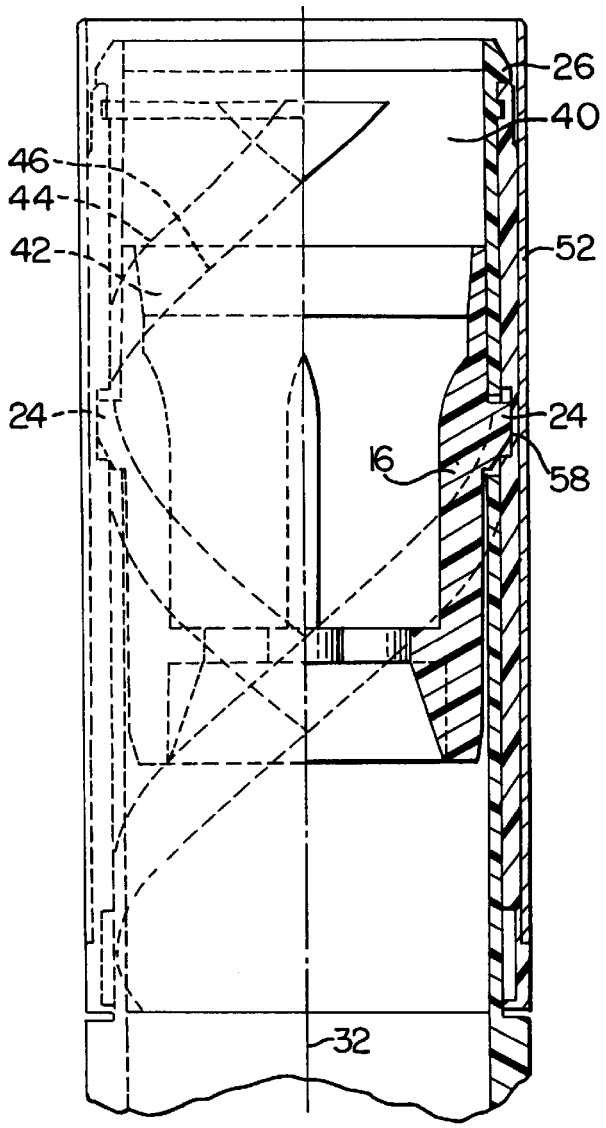
FIG. 5 is a partial cross-sectional view of the cosmetic container of FIG. 1 as axial pressure is applied thereto.

The cosmetic carrier 16 is positioned within a tubular inner sleeve 26, as best shown in FIGS. 2, 3 and 5. The tubular inner sleeve 26 includes, on opposing sidewalls, a pair of longitudinal slots 30 which extend parallel to the longitudinal axis 32. Positioning of the cosmetic carrier 16 is enhanced by the integral opening 34 provided along the distal portion 36 of the tubular inner sleeve 26. Once positioned within the tubular inner sleeve 26, the cosmetic carrier 16 is movable longitudinally upwardly or downwardly within the inner sleeve 26. The longitudinal slots 30 permit the lugs 24 of the cosmetic carrier 16 to extend therethrough. At its proximal end, the tubular inner sleeve comprises a manually rotatable base 38 which will be discussed more fully below.

A tubular intermediate sleeve 40 is positioned circumferentially around the tubular inner sleeve 26. The intermediate sleeve 40 has a pair of opposed helical channels 42 formed on the inner surface of sleeve 40. The helical channels 42 is defined by opposing upper 44 and lower 46 sidewalls and a bottom wall 48 and is configured to receive at least a portion of the lug or lugs 24 as shown in the various figures. The intermediate sleeve 40 further includes a proximal portion 50 forming an outwardly extending flange.

Positioned circumferentially around the intermediate sleeve 40 and the helical channel 42 is a tubular outer sleeve 52 which, in a preferred embodiment, is a decorative component. In an alternative embodiment, the intermediate sleeve 40 and the tubular outer sleeve 52 may be integrally formed wherein the tubular outer sleeve 52 may constitute the bottom wall of the helical channel 42 and the intermediate sleeve 40 includes a helical slot (not shown) defined by upper and lower sidewalls.

The above described components of the cosmetic container 20 permit easy application of the lipstick by permitting the lipstick to be extended and retracted within the lipstick container 10 while push-back is substantially diminished, if not prevented, due, particularly, to the uniquely configured lug 24 which cooperates with the intermediate sleeve 40 and the helical channel 42. The assembly, shown exploded in FIG. 2, is maintained in proper alignment and positioning due to the configuration of the various components. For instance, the distal portion 36 of the tubular inner sleeve 26 includes a thickened portion extending radially outwardly so as to form a flange. Similarly, the rotatable base 38 also forms a flange wherein the intermediate sleeve 40 and the tubular outer sleeve 52 are retained between the flange 36 and the rotatable base 38. The tubular outer sleeve is properly positioned about the intermediate sleeve 40 due to the proximal portion 50 of the intermediate sleeve 40 which, likewise, forms a thickened portion or flange.

The operation of the cosmetic container 10 according to the present invention will now be discussed with reference to the various figures. The cosmetic container extends and retracts the lipstick 12 to permit extension thereof beyond the distal end of the cosmetic container 10 so that it may be applied. The lipstick 12 is propelled within and from the cosmetic container 10 by removal of the outer enclosure 14 and by the rotation of the rotatable base 38 of the inner sleeve 26. Rotating the base 38 in a predetermined direction causes the cosmetic container 16 retained therein to likewise rotate due to the extension of the lugs 24 through the longitudinal slot 30 which would, inherently, abut a respective longitudinal side edge 54 defining the longitudinal slot 30 (depending upon the direction of rotation).

Because the lugs 24 are also received, or at least a portion thereof, within the helical channel 42, as the rotatable base 38 of the inner sleeve 26 is rotated, the cosmetic carrier 16 traverses the length of the helical channel 42 of the intermediate sleeve 40 wherein it moves upward or downward within the longitudinal slot 30. At each of the distal and proximal ends of the longitudinal slot 30 are provided laterally extending locking extensions 56 which, as shown, are formed integrally with the longitudinal slot 30. The locking extensions 56 limit the upward movement of the cosmetic carrier 16 so that, when the cosmetic carrier 16 reaches the uppermost position, it is restrained from further upward movement as further rotatable movement of the base 38 is prohibited. Likewise, at the proximal end, when the lipstick 12 within the cosmetic container 16 is fully retracted, further retraction is limited due to the retention of the lug within the laterally extending locking extension 56 of the longitudinal slot 30. Thus, the lipstick 12 may be extended by rotating the rotatable base 38 in one direction, and retracted by rotating the rotatable base 38 in the opposite direction to permit easy application while protecting the lipstick within the container 10 when not in use.

A low swivel torque and a smoothly operating lipstick container 10 is achieved by the present invention, at least in part, by providing the helical channel 42 at a desired slope and pitch. In the preferred embodiment, the slope of the helical channel 42 is between 15° and 45°. Also in the preferred embodiment, the pitch of the helical channel 42, i.e. the distance P between adjacent portions of the helical channel 42 (when viewed from the front as shown in FIG. 3), is between 0.25 and 0.75 inches and, more preferably, between 0.45 and 0.6 inches. Thus, a smoothly operating cosmetic container 10 is provided which permits a low swivel torque to rotate the rotatable base 38 to extend and, likewise retract, the lipstick 12 for application and storage thereof.

Figure 4:
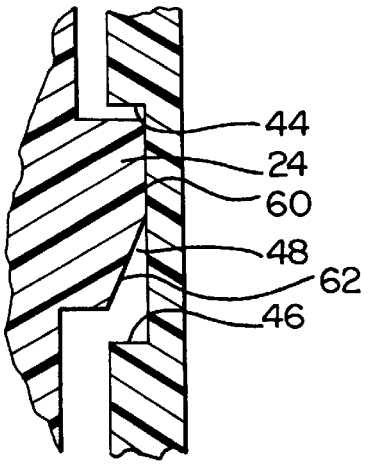
FIG. 4 is a cross-sectional view of an enlarged portion taken from FIG. 3.

The aforementioned problem of push-back experienced by prior art cosmetic containers is avoided according to the present invention by providing a uniquely configured lug 24 which cooperates with an inner surface portion of the intermediate sleeve 40. The lug 24 extends radially outward from the cosmetic carrier 16 which has a radially outwardly facing end 58 which is configured to prevent downward movement of the cosmetic carrier 16 under downward axial force applied to the cosmetic 12 and, hence, the cosmetic carrier 16 such as when the lipstick 12 is being applied. As best shown in FIGS. 4 and 5, the facing end 58 is configured to cooperate with the intermediate sleeve 40 and the helical channel 42 to minimize and/or prevent the aforementioned push-back. The configuration of the radially outwardly facing end 58 includes a surface which produces a wedging effect against an inner surface of the intermediate sleeve 40 when downward axial pressure is applied to the cosmetic 12 within the carrier 16 to lessen unwanted push-back. Stated otherwise, the end facing has a surface portion which is chamfered. More particularly, in the specific embodiment illustrated, the facing end 58 has a compound surface including first 60 and second 62 radially outwardly facing surface portions. The first surface portion is oriented generally parallel to the longitudinal axis 32 of the cosmetic container 10 and faces radially outwardly toward the bottom wall 48 of the helical channel 42. The second surface portion 62 is oriented at an acute angle to the longitudinal axis 32 of the cosmetic container 10 for wedging against an inner surface portion of the intermediate sleeve 40 adjacent the lower sidewall portion 46 of the helical channel 42 under a downward axial force applied to the cosmetic 12 to prohibit push-back. Accordingly, the lug 24 is configured to cooperate with the tubular intermediate sleeve 40 to prevent push-back.

Figure 7:
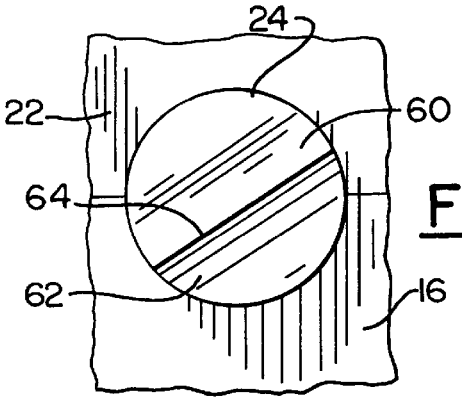
FIG. 7 is a side elevational view of the radially outwardly facing end of the lug according to the present invention.

A line of intersection 64 differentiates the first and second radially outwardly facing surface portions 60 and 62, respectively, and is oriented at an acute angle with respect to a plane normal to the longitudinal axis of the tubular inner sleeve 26. The line of intersection 64 is best shown in FIG. 7, and in phantom in FIG. 2. The angular orientation of the line of intersection 64 corresponds, in a preferred embodiment, to the slope of the helical channel 42 so that the line of intersection is generally parallel to the sidewalls 44 and 46 of the channel 42. Preferably, the acute angle is between 25° and 45°.

The compound surface of the radially outwardly facing end 58 of the lug 24 includes a surface portion, such as the second surface portion 62, which is oriented at an acute angle to the longitudinal axis of the tubular inner sleeve 26 for wedging an inner surface portion of the intermediate sleeve 40 adjacent the lower sidewall 46 of the helical channel to prevent push-back. Preferably, this acute angle is between 12° and 20°. The adjoining first surface portion 60 is oriented generally parallel to the longitudinal axis 32 of the sleeve facing towards the bottom 48 of helical channel 42. Accordingly, the facing end 58 of the lug 24 is a compound surface in that two surface portions are provided wherein one is parallel to the longitudinal axis and one is provided at an acute angle to the longitudinal axis. Further, the line of intersection 64 defining the first and second surface portions 60 and 62 is, itself, oriented at an angle, preferably an acute angle, with respect to a plane normal to the longitudinal axis 32 of the inner sleeve 26.

The operation of the cosmetic container 10 absent downward axial force applied thereto is best shown in FIGS. 3 and 4. As shown in FIG. 3, the lug 24 freely traverses the length of the helical channel 42 when the rotatable base 38 is rotated such as when the lipstick 12 is being extended for application or retracted for storage. FIG. 4 illustrates an enlarged cross-sectional view of the lug 24 within the helical channel 42. As shown, the first radially outwardly facing surface portion may engage the bottom wall 48 of channel 42. However, the angular or chamfered end surface portion 62 does not abut either of the walls 44 or 46 of the helical channel 42. Thus, the lug 24 freely traverses the length of the channel 42.

Figure 6:
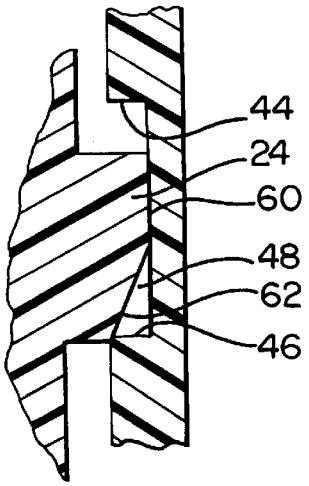
FIG. 6 is a cross-sectional view of an enlarged portion of FIG. 5.

In contrast, FIGS. 5 and 6 illustrate the cosmetic container 10 when downward axial force is applied to the cosmetic 12 within the cosmetic carrier 16 such as when the cosmetic is being applied. Under this condition, the second surface portion 62 of the facing end 58 of the lug 24 abuts the inner surface of the intermediate sleeve 40 adjacent the lower sidewall 46 of the helical channel 42, producing a wedging function which prevents the lipstick 12 from being undesirably pushed back into the cosmetic container 10. The cosmetic carrier 16 is restrained from significant downward movement due to the cooperation of the facing end 58 of the lug 24 with the intermediate sleeve 40.

An enlarged cross-sectional view wherein the second surface portion 62 abuts an inner surface of the intermediate sleeve adjacent the lower sidewall 46 of the helical channel 42 is shown in FIG. 6. Accordingly, push-back is effectively and efficiently minimized and/or prevented because downward movement of the cosmetic carrier 16 within the inner sleeve 26 is eliminated due to the abutting surfaces yet, the lipstick is readily extended and retracted if so desired. This results without diminishing the smooth operation of the cosmetic container 10 which permits only a minimal swivel torque to operate the container 10 for application of the cosmetic 12. Moreover, push-back is prevented in a manner which is easily manufactured and uncomplicated due to the uniquely configured facing end 58 of the lug 24 which cooperates with the intermediate sleeve 40 and/or the outer tubular sleeve 52.

Figure 8:
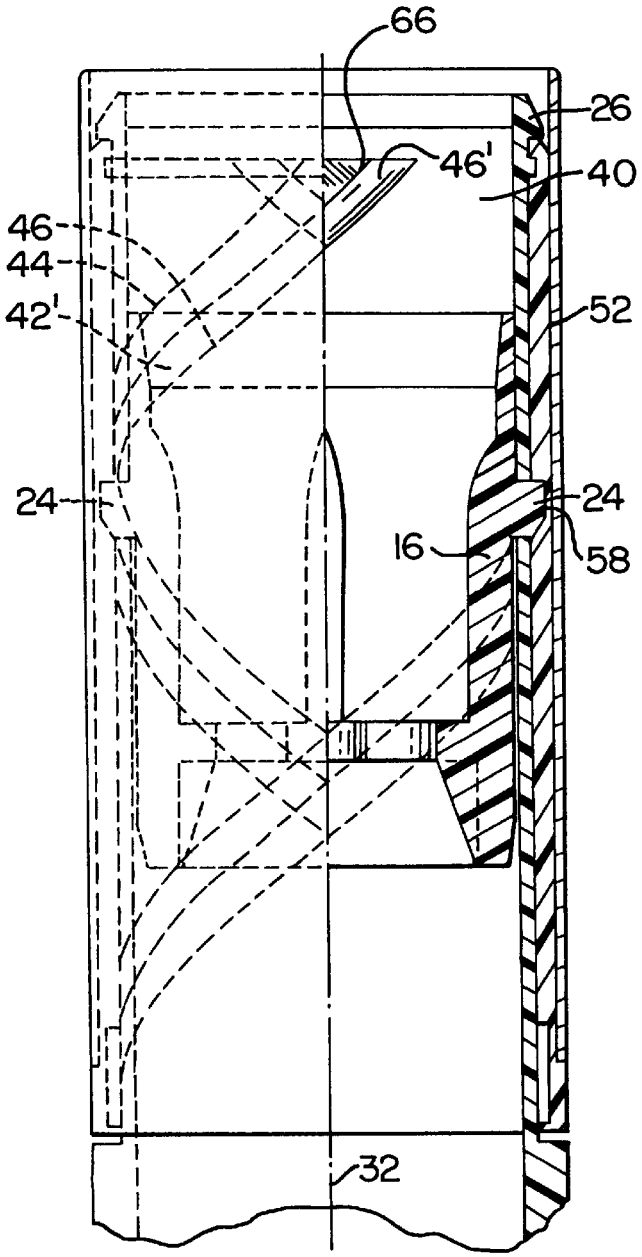
FIG. 8 is a partial cross-sectional view of the cosmetic container according to an alternative embodiment of the present invention.
Figure 9:
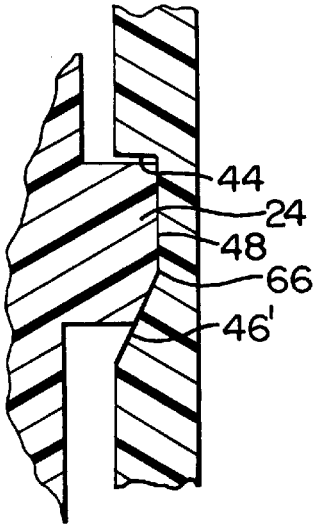
FIG. 9 is a cross-sectional view of an enlarged portion of FIG. 8.

An alternative embodiment of the present invention is illustrated in FIGS. 8 and 9 wherein the reference numerals for like elements correspond with the reference numerals for FIGS. 1–7 and those elements which are similar to those previously described will bear the same reference number with the prime notation (') added. This embodiment differs, particularly, in the configuration of the helical channel 42. The helical channel 42' includes an upper sidewall 44 and bottom wall 48. The lower sidewall 46' is oriented at an obtuse angle to the bottom wall 48 which is oriented generally parallel to the longitudinal axis. The sidewall 46' thus forms an angularly oriented wedging surface for cooperating with the lug 24. This angularly oriented surface forms an acute angle to the longitudinal axis of the sleeve 26. The lower sidewall 46' cooperates with the second radially outwardly facing surface portion 62 for wedging thereagainst under downward axial force applied to the cosmetic 12 to minimize push-back. A line of intersection 64 differentiates the bottom wall 48 and the lower sidewall 46' and is oriented at an acute angle with respect to a plane normal to the longitudinal axis of the tubular inner sleeve 26.

The angular orientation of the line of intersection 64 corresponds, in a preferred embodiment, to the slope of the helical channel. Accordingly, the line of intersection 64, is generally parallel to the upper sidewall 44 and the line of intersection 64 defining the first 60 and second 62 radially outwardly facing surface portions of the lug 24. The helical channel 42 thus includes a compound surface substantially corresponding to the compound surface of the lug 24 end surface portion and which is defined by two surfaces 48 and 46' wherein the lower sidewall 46' is angularly oriented. Further, the compound surface includes the line of intersection 64 which, too, is angularly oriented, preferably at an acute angle, with respect to a plane normal to the longitudinal axis 32 of the inner sleeve 26.

A third embodiment of the present invention is illustrated in FIGS. 10–13. To avoid repetitive description, elements of the cosmetic container which are identical to those previously described will be identified with the same reference numbers, and those elements which are similar to those previously described will bear the same reference number with prime notation (') added. According to this embodiment, the aforementioned problem of push-back experienced by prior art cosmetic containers is also avoided by providing another form of uniquely configured lug 24' which cooperates with an inner surface portion of the intermediate sleeve 40. The lug 24' extends radially outward from the cosmetic carrier 16 and includes a radially outwardly facing end 58' which, similar to the facing end 58 of the prior embodiment, is configured to prevent downward movement of the cosmetic carrier 16 under downward axial force applied to the cosmetic 12 and, hence, the cosmetic carrier 16 (such as when the lipstick 12 is being applied).

Figure 10:
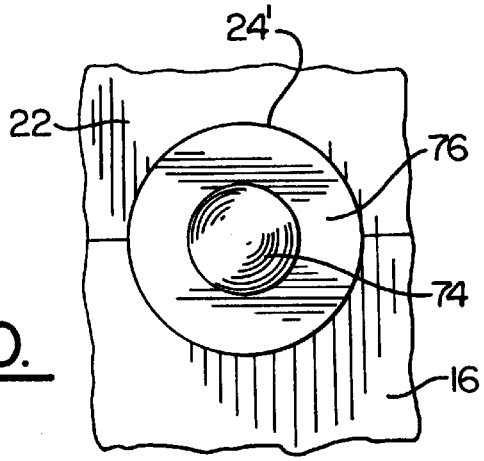
FIG. 10 is a side elevational view of the radially outwardly facing end of the lug according to a third embodiment of the present invention.
Figure 11:
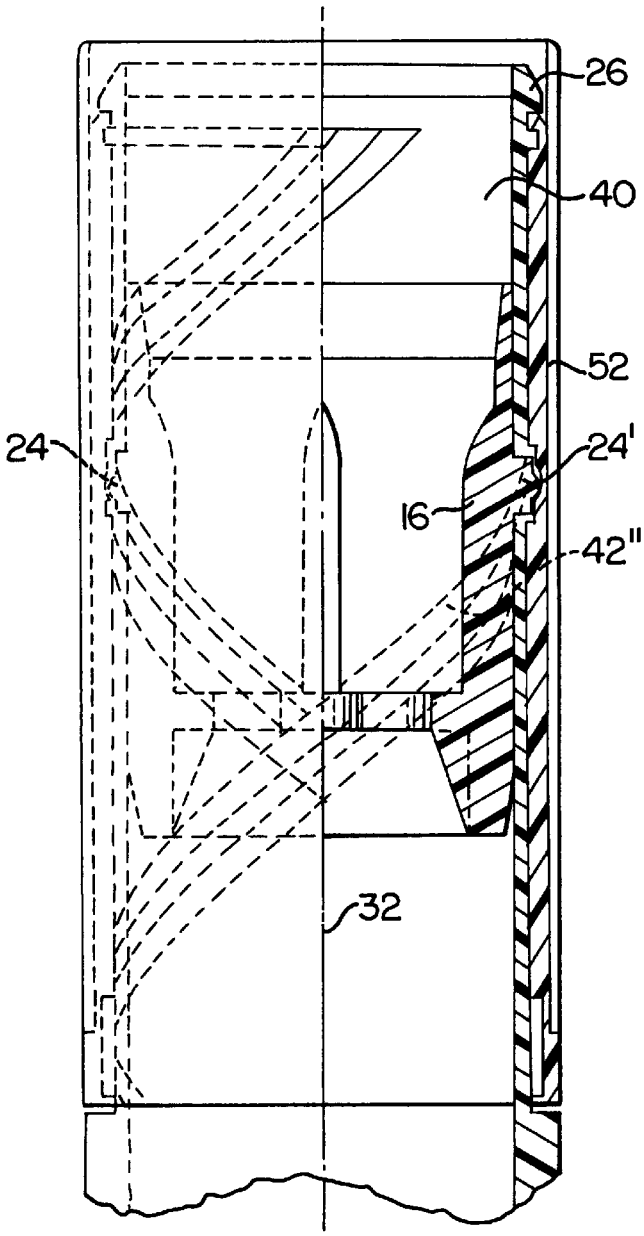
FIG. 11 is a partial cross-sectional view of the cosmetic container according to the third embodiment of the present invention.

As shown in the various figures, the radially outwardly facing end 58' is configured to cooperate with the intermediate sleeve 40 and the helical channel 42' to minimize and/or prevent the aforementioned push-back. The radially outwardly facing end 58' is defined by a curved surface portion 74 defined by a convex protrusion extending radially outward from the facing end 58'. As best illustrated in FIG. 10, the facing end 58' is defined by the convex protrusion 74 which is surrounded by a substantially planar surface 76.

The helical channel 42" is defined by upper and lower sidewalls 44 and 46 and a bottom wall 48'. The bottom wall 48' differs from the helical channel 42 of the other embodiments and is defined by a substantially planar portion 80 and a centrally positioned, substantially concave portion 82 so as to be correspondingly configured with the radially outward facing end 58' of the lug 24'. The concave portion 82 of the facing end 58' extends along the length of the helical channel permitting the lug to traverse the length of the helical channel 42" as in the prior embodiment. Accordingly, the substantially planar surface 76 of the facing end 58' extends in substantially the same plane as the planar portion 80 of the bottom wall 58'.

Figure 12:
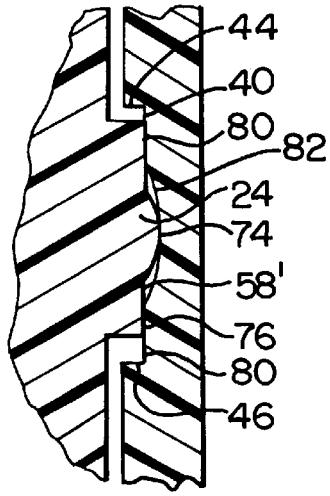
FIG. 12 is a cross-sectional view of an enlarged portion taken from FIG. 11.
Figure 13:
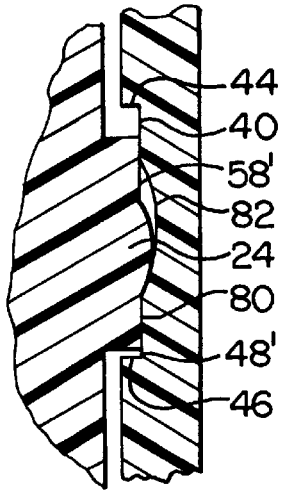
FIG. 13 is a cross-sectional view of an enlarged portion taken from FIG. 11.

The concave portion 82 of the bottom wall 48' has a radius which is greater than the outer radius of the curved surface portion 74 of the facing end 58'. Preferably the radius of curvature of the concave portion 82 of the bottom wall 76 of the helical channel 42" at least twice the radius of curvature of the curved surface portion 74. This arrangement, as best illustrated in FIG. 12, ensures that the lug 24' is permitted to easily traverse the length of the helical channel 42" so that the lipstick 12 may be extended for application or retracted for storage. When downward axial pressure is applied to the lipstick 12 and, hence, the cosmetic carrier 16 such as when the lipstick is being applied, the unique configuration of the facing end 58' of the lug 24' and the bottom wall 48' of the helical channel 42" prevents the aforementioned push-back. The application of downward axial pressure is illustrated in FIG. 13. Due to the smaller radius of the curved surface portion 74 of the facing end, it is urged against the concave portion having a greater radius of curvature. This contact provides an abutting surface for the lug 24 which, therefore, is prevented from being substantially retracted further within lipstick container 10.

While particular embodiments of the invention have been described, it will be understood, of course, the invention is not limited thereto since modifications may be made by those skilled in the art, particularly in light of the foregoing teachings. It is therefore, contemplated by the appended claims to cover any such modifications that incorporate those features of these improvements in the true spirit and scope of the invention.

I claim:

1. A cosmetic container comprising a first tubular sleeve; a helical channel extending along an inner periphery of said tubular sleeve; a cosmetic carrier movable longitudinally upwardly or downwardly within said first tubular sleeve; and at least one lug extending radially outwardly from said cosmetic carrier, said lug having a radially outwardly facing end which is chamfered so as to define first and second surface portions which form a line of intersection which is oriented at an acute angle with respect to a plane normal to a longitudinal axis of said first tubular sleeve, said first surface portion being oriented generally parallel to the longitudinal axis of said first tubular sleeve, said at least one lug being received in said helical channel of said first tubular sleeve, said radially outwardly facing end having a configuration which prevents downward movement of said cosmetic carrier under a downward axial force applied to said cosmetic carrier.

2. A cosmetic container according to claim 1, wherein said second surface portion is oriented at an acute angle to the longitudinal axis of said sleeve for wedging against a portion of the tubular sleeve under downward axial force applied to said cosmetic carrier.

3. A cosmetic container according to claim 2, wherein said helical channel is defined by a bottom wall and opposing upper and lower sidewalls formed in said first tubular sleeve, said first surface portion being oriented generally parallel to the longitudinal axis of said first tubular sleeve and facing radially outwardly toward said bottom wall of said helical channel.

4. A cosmetic container according to claim 3, wherein said second surface portion extends at an angle between 12° and 20° with respect to the longitudinal axis of said sleeve.

5. A cosmetic container according to claim 1, wherein said line of intersection has an angular orientation which corresponds to a slope of said helical channel so that said line of intersection is generally parallel to said helical channel.

6. A cosmetic container according to claim 1, wherein said acute angle is within the range of 25° to 45°.

7. A cosmetic container according to claim 1, additionally including a tubular inner sleeve rotatable within said first tubular sleeve, with a longitudinal slot formed in said tubular inner sleeve extending parallel to the longitudinal axis thereof; and wherein said cosmetic carrier is movable longitudinally upwardly or downwardly within said tubular inner sleeve with said lug extending radially outwardly through said longitudinal slot of said tubular inner sleeve wherein a portion of said tubular inner sleeve extends axially beyond the lower end of said first tubular sleeve to define a manually rotatable base so that upon rotation of said base, said cosmetic carrier will be propelled longitudinally upwardly or downwardly within said first tubular sleeve.

8. A cosmetic container according to claim 1 wherein said lug is substantially round in cross section.

9. A cosmetic container comprising a first tubular sleeve; a helical channel extending along the inner periphery of said first tubular sleeve and being defined by a bottom wall and opposing upper and lower sidewalls formed in said first tubular sleeve; a cosmetic carrier movable longitudinally upwardly or downwardly within said first tubular sleeve; and at least one lug extending radially outwardly from said cosmetic carrier, said lug having a radially outwardly facing end received in said helical channel of said first tubular sleeve so that said cosmetic carrier is propelled longitudinally upwardly or downwardly within said first tubular sleeve, said facing end including first and second radially outwardly facing surface portions, said first surface portion being oriented generally parallel to the longitudinal axis of said first tubular sleeve and facing radially outwardly toward said bottom wall of said helical channel, and said second surface portion being oriented at an acute angle to the longitudinal axis of said first tubular sleeve, said bottom wall of said helical channel being oriented substantially parallel to the longitudinal axis of said first tubular sleeve and said upper sidewall extending substantially perpendicular to said bottom wall, wherein said radially outwardly facing end wedges against a portion of said first tubular sleeve to prevent downward movement of said cosmetic carrier under a downward axial force applied to said cosmetic carrier.

10. A cosmetic container according to claim 9, wherein said cosmetic carrier includes a base and a cylindrical sidewall extending upwardly from said base to define a cup for receiving and holding a cosmetic, said at least one lug comprising a pair of diametrically opposed lugs extending radially outwardly from opposite sides of said cylindrical sidewall.

11. A cosmetic container according to claim 9 wherein said first and second radially outwardly facing surface portions of said lug form a line of intersection therebetween, said line of intersection having an angular orientation which extends at an acute angle with respect to a plane normal to the longitudinal axis of said first tubular sleeve.

12. A cosmetic container according to claim 11, wherein the angular orientation of said line of intersection corresponds to a slope of said helical channel so that said line of intersection is generally parallel to a slope of said helical channel.

13. A cosmetic container according to claim 9 wherein said lower sidewall of said helical channel is oriented at an acute angle with respect to the longitudinal axis of said first tubular sleeve.

14. A cosmetic container comprising a first tubular sleeve; a helical channel extending along the inner periphery of said first sleeve and being defined by a bottom wall and opposing upper and lower sidewalls formed in said first tubular sleeve; a cosmetic carrier movable longitudinally upwardly or downwardly within said first tubular sleeve; and at least one lug extending radially outwardly from said cosmetic carrier, said lug having a radially forwardly facing end received in said helical channel of said first tubular sleeve so that said cosmetic carrier is propelled longitudinally upwardly or downwardly within said first tubular sleeve; said facing end including first and second radially outwardly facing surface portions, said first surface portion being oriented generally parallel to the longitudinal axis of said first tubular sleeve and facing radially outwardly toward said bottom wall of said helical channel, and said second surface portion being defined substantially by a curved portion oriented to mate with a correspondingly configured surface portion of said helical channel for wedging against a portion of said first tubular sleeve to prevent downward movement of said cosmetic carrier under a downward axial force applied to said cosmetic carrier.

15. A cosmetic container according to claim 14 wherein said second radially outwardly facing surface portion is a convex protrusion and said correspondingly configured surface portion of said helical channel includes a concave channel.

16. A cosmetic container according to claim 14, wherein said second surface portion is a convex protrusion extending radially outward from said facing end for wedging against said lower sidewall of said helical channel under downward axial force applied to said cosmetic carrier.

17. A cosmetic container comprising a first tubular sleeve; a helical channel extending along an inner periphery of said first tubular sleeve; a cosmetic carrier movable longitudinally upwardly or downwardly within said first tubular sleeve; at least one lug extending radially outwardly from said cosmetic carrier, said lug having a radially outwardly facing end received in said helical channel of said first tubular sleeve, said helical channel being defined by a bottom wall oriented substantially parallel to the longitudinal axis of said first tubular sleeve, an upper sidewall extending substantially perpendicular to said bottom wall, and a lower sidewall oriented at an acute angle to the longitudinal axis of said first tubular sleeve for wedging against said lug.

18. A cosmetic container according to claim 17 wherein said lug comprises a facing end including a radially outwardly facing surface portion which is oriented at an acute angle to the longitudinal axis of said sleeve for wedging against said lower sidewall of said helical channel under downward axial force applied to said cosmetic carrier.

19. A cosmetic carrier for use in a cosmetic container, said cosmetic carrier comprising a base, a cylindrical sidewall extending upwardly from said base to define a cup for receiving and holding a cosmetic, and a pair of diametrically opposed lugs extending radially outwardly from opposite sides of said cylindrical sidewall, said lugs each being round in cross section and having a radially outwardly facing end defining a chamfered surface including a surface portion which is oriented generally parallel to a longitudinal axis of said cosmetic carrier and which includes a surface configuration which prevents downward movement of the cosmetic carrier within a cosmetic container under a downward axial force applied to said cosmetic carrier.

20. A cosmetic carrier according to claim 19, wherein said radially outwardly facing end includes a radially outwardly facing surface portion which is oriented at an acute angle to a longitudinal axis of said cylindrical sidewall.

21. A cosmetic carrier according to claim 20, wherein said acute angle is between 12° and 20°.

22. A cosmetic carrier according to claim 19, wherein said radially outwardly facing end includes said chamfered surface and an adjoining radially outwardly facing surface portion oriented generally parallel to a longitudinal axis of said cosmetic carrier.

23. A cosmetic container comprising a first tubular sleeve; a helical channel extending along an inner periphery of said tubular sleeve; a cosmetic carrier movable longitudinally upwardly or downwardly within said first tubular sleeve; at least one lug extending radially outwardly from said cosmetic carrier, said lug having a radially outwardly facing end including first and second radially outwardly facing surface portions, said first radially outwardly facing surface portion being oriented generally parallel to the longitudinal axis of said first tubular sleeve and said second radially outwardly facing surface portion including a curved portion, at least said first and second radially outwardly facing surface portions being received in said helical channel of said first tubular sleeve, and said radially outwardly facing end has a configuration which prevents downward movement of said cosmetic carrier under a downward axial force applied to said cosmetic carrier.

24. A cosmetic container according to claim 23 wherein said curved portion of said second radially outwardly facing surface portion is a convex protrusion and said helical channel includes a bottom wall having a concave channel for cooperating with said convex protrusion.

25. A cosmetic container comprising a first tubular sleeve; a helical channel extending along an inner periphery of said first tubular sleeve; a cosmetic carrier movable longitudinally upwardly or downwardly within said first tubular sleeve; and at least one lug extending radially outwardly from said cosmetic carrier, said lug having a radially outwardly facing end which is substantially round in cross section and which is defined by a compound surface, and said helical channel includes a compound surface which is matingly configured as said radially outwardly facing end of said lug, said lug being received in said helical channel of said first tubular sleeve and said radially outwardly facing end having a configuration which wedges against said helical channel to prevent downward movement of said cosmetic carrier under a downward axial force applied to said cosmetic carrier.

26. A cosmetic container according to claim 25, wherein the radially outwardly facing end of said lug is chamfered.

27. A cosmetic container according to claim 25, wherein said lug includes a convex protrusion on said radially outwardly facing end extending radially outward therefrom.

28. A cosmetic container according to claim 27, wherein said lug additionally includes a substantially planar surface on said radially outwardly facing end surrounding said convex protrusion.

29. A cosmetic container according to claim 25, wherein said helical channel includes a bottom wall which is oriented substantially parallel to the longitudinal axis of said first tubular sleeve, said bottom wall including a curved surface portion configured to receive a curved surface portion of said lug.

30. A cosmetic container according to claim 29, wherein said curved surface portion of said bottom wall of said helical channel comprises a first radius of curvature and said curved portion of said lug comprises a second radius of curvature, said first radius of curvature being greater than said second radius of curvature.

31. A cosmetic container according to claim 25, wherein said bottom wall of said helical channel is substantially defined by a planar wall having a concave surface portion positioned between a upper and lower sidewalls of said helical channel, said concave surface portion extending along at least a length of said helical channel.

32. A cosmetic container comprising a first tubular sleeve; a helical channel extending along an inner periphery of said first tubular sleeve; a cosmetic carrier movable longitudinally upwardly or downwardly within said first tubular sleeve; and at least one lug extending radially outwardly from said cosmetic carrier, said lug having a radially outwardly facing end received in said helical channel of said first tubular sleeve, said helical channel being defined by first and second surface portions, said first surface portion being oriented generally parallel to the longitudinal axis of said first tubular sleeve, and said second surface portion being defined substantially by a curved portion for wedging against said lug.

33. A cosmetic container according to claim 32 wherein said curved surface portion of said helical channel is concave.

* * * * *

UNITED STATES PATENT AND TRADEMARK OFFICE

CERTIFICATE OF CORRECTION

PATENT NO. : 5,842,804

DATED : December 1, 1998

INVENTOR(S) : Hurlburt

It is certified that error appears in the above-identified patent and that said Letters Patent is hereby corrected as shown below:

On the title page under

Assignee (Item [73]), cancel the comma (,) before "Inc."

Related U.S. Application Data (Item [23]), should read -- Continuation of Ser. No. 08/627,234, March 28, 1996 --.

References Cited (Item [56]), FOREIGN PATENT DOCUMENTS, last line, "95/16773" should read -- 95/16373 --.

ABSTRACT (Item [57]), line 18, after "surface" insert -- of --.

Signed and Sealed this

Fourth Day of May, 1999

*Attest:*

Q. TODD DICKINSON

*Attesting Officer*

*Acting Commissioner of Patents and Trademarks*